US011214903B2

(12) United States Patent
Uyama et al.

(10) Patent No.: US 11,214,903 B2
(45) Date of Patent: Jan. 4, 2022

(54) SEWING MACHINE

(71) Applicant: BROTHER KOGYO KABUSHIKI KAISHA, Nagoya (JP)

(72) Inventors: Yoshiyuki Uyama, Nagoya (JP); Masahisa Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 84 days.

(21) Appl. No.: 16/692,419

(22) Filed: Nov. 22, 2019

(65) Prior Publication Data

US 2020/0173082 A1 Jun. 4, 2020

(30) Foreign Application Priority Data

Nov. 30, 2018 (JP) ..... JP2018-225279

(51) Int. Cl.
*D05B 65/00* (2006.01)
*D05B 73/12* (2006.01)

(52) U.S. Cl.
CPC ..... *D05B 65/003* (2013.01); *D05B 73/12* (2013.01)

(58) Field of Classification Search
CPC .. D05B 65/00–06; D05B 73/00; D05B 73/02; D05B 73/12
See application file for complete search history.

(56) References Cited

U.S. PATENT DOCUMENTS 2,198,664 A * 4/1940 Fogarty ..... A47F 13/04 30/127
2,261,680 A * 11/1941 Hale ..... D05B 65/003 112/298
2,423,001 A * 6/1947 Blowers ..... D05B 65/003 112/288
2,867,184 A * 1/1959 Klapper ..... D05B 65/003 112/295
4,130,038 A * 12/1978 Zehnder ..... B65H 54/71 83/175
4,453,481 A * 6/1984 Garnett ..... D05B 65/00 112/288
4,465,006 A * 8/1984 Dreier ..... D05B 65/003 112/292
4,606,289 A 8/1986 Hara et al.

FOREIGN PATENT DOCUMENTS

JP S58-97392 A 6/1983
JP S59-178980 U 11/1984
JP H10-179969 A 7/1998
JP 2001062162 A * 3/2001
JP 2018-130435 A 8/2018

OTHER PUBLICATIONS

Nov. 2, 2021 Notice of Reasons for Refusal in Japanese Patent Application No. 2018-225279.

* cited by examiner

*Primary Examiner* — Ismael Izaguirre
(74) *Attorney, Agent, or Firm* — Oliff PLC

(57) ABSTRACT

A sewing machine includes a thread cutter. The thread cutter includes a cutter blade having a blade edge configured to cut a thread, and a movable member. The movable member includes a guide having a guide surface adjacent to the cutter blade. The guide is configured to receive force from the thread at the guide surface during the course of cutting the thread with the cutter blade and to move in a moving direction which is a longitudinal direction of the blade edge.

13 Claims, 9 Drawing Sheets

SEWING MACHINE

CROSS-REFERENCE TO RELATED APPLICATION

This application claims priority from Japanese Patent Application No. 2018-225279 filed on Nov. 30, 2018, the content of which is incorporated herein by reference in its entirety.

TECHNICAL FIELD

Aspects described herein relate to a sewing machine.

BACKGROUND

A known sewing machine includes a thread cutter provided at a face plate of the sewing machine for cutting a thread manually. The thread cutter includes a cutter blade and a thread guide groove. The cutter blade is fixed to the sewing machine such that a blade edge of the cutter blade faces upward. The thread guide groove is configured to guide a thread to be cut toward the cutter blade. A user guides a thread toward the cutter blade through the thread guide groove. While contacting the thread with the blade edge of the cutter blade, the user pulls the thread downward, to cut the thread with the cutter blade.

SUMMARY

In the known sewing machine, a thread slidably moves downward along the blade edge to its end portion where the thread is pulled down and cut. Since the end portion of the blade edge is particularly used for cutting threads, the end portion may be worn. This may result in unsmooth thread cutting.

One or more aspects described herein provide a sewing machine that may eliminate or reduce influences of wear of a cutter blade of a thread cutter.

According to one or more aspects, a sewing machine may comprise a thread cutter. The thread cutter may include a cutter blade having a blade edge configured to cut a thread, and a movable member. The movable member may include a guide having a guide surface adjacent to the cutter blade. The guide may be configured to receive force from the thread at the guide surface during the course of cutting the thread with the cutter blade and to move in a moving direction which is a longitudinal direction of the blade edge.

The sewing machine may include the guide having the guide surface. The guide may receive force from the thread at the guide surface, during the course of cutting the thread with the cutter blade and to move in a longitudinal direction of the blade edge. The thread may slidably move in the longitudinal direction of the blade edge while pushing the guide surface, and be cut with a sharp portion (e.g., unworn portion) of the blade edge. The sewing machine may prevent or reduce wear of a particular portion of the blade edge of the cutter blade. This may eliminate or reduce influences of the wear of the cutter blade of the thread cutter when cutting a thread with the cutter blade.

DETAILED DESCRIPTION

Figure 1:
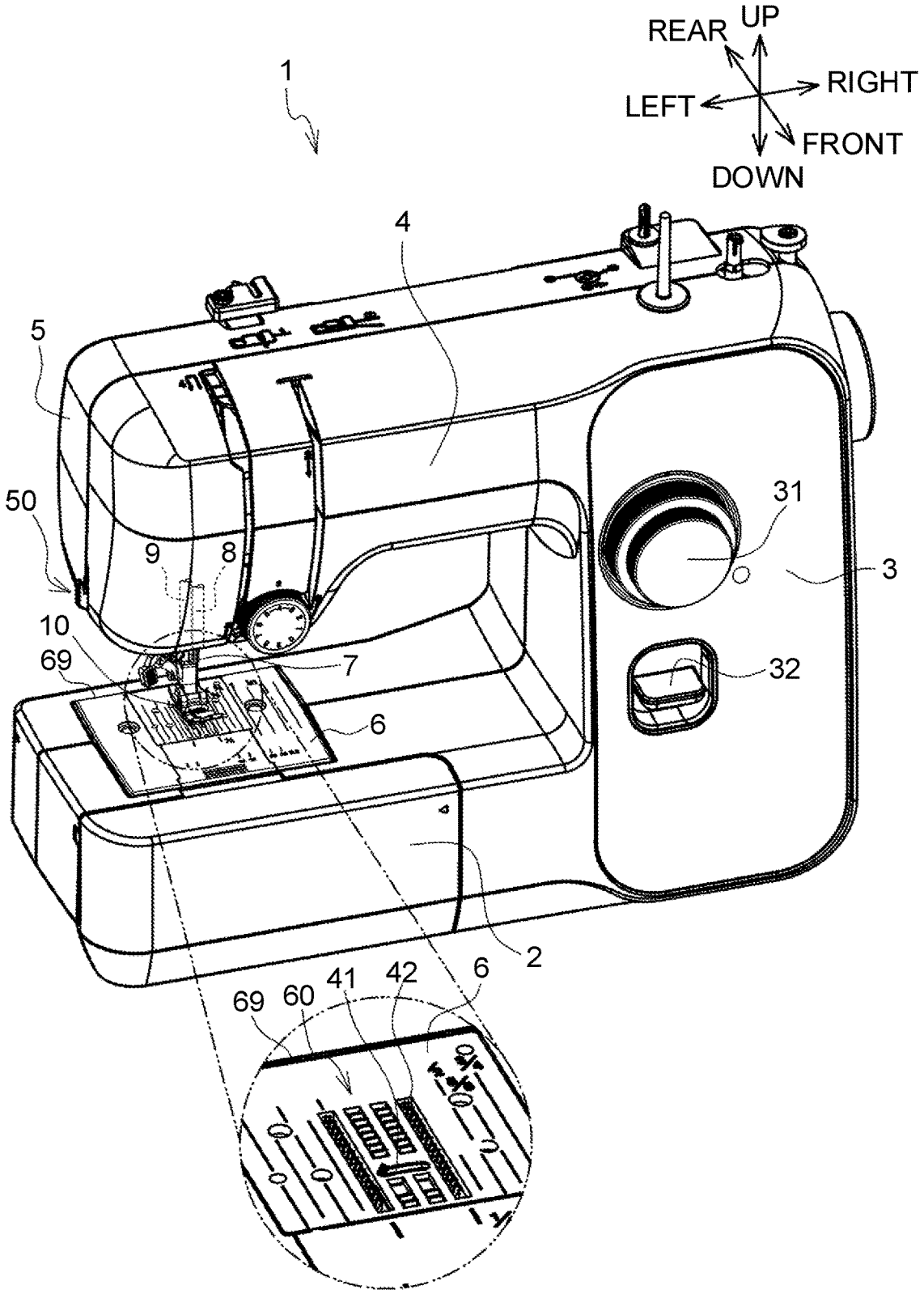
FIG. 1 is a perspective view of a sewing machine in an illustrative embodiment according to one or more aspects of the disclosure.

First, second and third illustrative embodiments will be described with reference to the accompanying drawings. Referring to FIG. 1, a physical configuration of a sewing machine 1 that is common to the first to third illustrative embodiments will be described. In the following description, directional terminology, such as "up/upper," "down/lower," "front," "rear," "left," "right" etc., as labeled in the drawings, may be used. In the page of FIG. 1, an upper side, a lower side, a lower right side, an upper left side, a lower left side, and an upper right side respectively correspond to an upper side, a lower side, a front side, a rear side, a left side, and a right side of the sewing machine 1. A longitudinal direction of a bed 2 and a horizontal arm 4 corresponds to a left-right direction of the sewing machine 1. A side of the sewing machine 1 on which an upright arm 3 is disposed is the right side. A direction in which the upright arm 3 is elongated is an up-down direction of the sewing machine 1.

As depicted in FIG. 1, the sewing machine 1 includes the bed 2, the upright arm 3, and the horizontal arm 4. The bed 2 is a base portion of the sewing machine 1, and extends in the left-right direction. The upright arm 3 extends upward from a right end portion of the bed 2. The horizontal arm 4 extends leftward from an upper end of the upright arm 3 and faces the bed 2. The sewing machine 1 includes a face plate 5 at an end (e.g., a left end) of the horizontal arm 4.

The bed 2 includes a needle plate 6 at an upper surface thereof. The needle plate 6 has a needle hole 41 that allows a needle 7 (described below) to pass therethrough. The needle plate 6 has a rear end 69. The sewing machine 1 includes a feed unit 60 and a shuttle mechanism that are housed in the bed 2. The feed unit 60 includes a feed dog 42 and a feed mechanism. The feed unit 60 is configured to feed a workpiece by a predetermined amount in a feed direction (e.g., toward the rear). The shuttle mechanism causes an upper thread to be entwined or intertwined with a lower thread underneath the needle plate 6. A dial 31 and a lever 32 are disposed at a front surface of the upright arm 3. The dial 31 is used to select one of stitch patterns, such as straight stitch patterns and zigzag stitch patterns. The lever 32 is used to input an instruction to sew reversely.

A needle bar 8, a presser bar 9, a needle bar drive mechanism, and a presser bar drive mechanism are disposed at an end portion of the horizontal arm 4. The needle bar 8 is located above the needle hole 41 and extends in the up-down direction. The needle 7 is removably attached to a lower end of the needle bar 8. The presser bar 9 is located behind the needle bar 8 and extends in the up-down direction. A presser foot 10 is removably attached to a lower end of the presser bar 9. The presser foot 10 is configured to move, together with the presser bar 9, between a lower position and an upper position. At the lower position, the presser foot 10 presses the workpiece down. At the upper position, the presser foot 10 is located at a higher position than when the presser foot 9 is located at the lower position, and is spaced from the workpiece. The presser foot 10 is configured to intermittently press the workpiece down in association with the up-down movement of the needle bar 8. The face plate 5 has a flat surface extending in the up-down direction, as well as the front-rear direction.

Referring to FIGS. 2 through 7, a configuration of a thread cutter 50 according to the first illustrative embodiment will now be described. The thread cutter 50 is configured to cut a thread, which may be either an upper thread or a lower thread. The thread cutter 50 is fixed to a fixing surface (e.g., the face plate 5) of the horizontal arm 4. The thread cutter 50 is fixed to a lower portion of the face plate 5, at a generally middle position of the face plate 5 in the front-rear direction. The thread cutter 50 includes a cutter blade 51, a movable member 53, a protrusion 59, a holder 61, a holding plate 63, a fixing portion 70, and a screw 67. The cutter blade 51 has a blade edge 52. The cutter blade 51 has a parallelogram shape elongated in the up-down direction in a front view. The blade edge 52 is located at an upper end portion of the cutter blade 51. The blade edge 52 extends obliquely in a blade length direction Y (e.g., a longitudinal direction of the blade edge 52) from the left upper side to the lower right side. The blade length direction Y crosses an extending surface of the needle plate 6. The cutter blade 51 has a thickness in the front-rear direction. In other words, a thickness direction of the cutter blade 51 corresponds to the front-rear direction. The cutter blade 51 has an extending surface that extends generally perpendicular to the face plate 5. The cutter blade 51 is located further to the rear than the needle bar 8 (or the needle hole 41) and further to the front than the presser bar 9. An angle B (in FIG. 2) defined by the blade edge 52 and the face plate 5 is an acute angle (e.g., 10-90 degrees). The cutter blade 51 is held by the holder 61 and the holding plate 63 from the front and the rear sides, such that the middle portion of the blade edge 52 in the blade length direction Y is exposed to an exterior of the sewing machine 1 (e.g., toward the protrusion 59). Opposite ends of the cutter blade 51 in the blade length direction Y and the lower end of the cutter blade 51 are held between the holder 61 and the holding plate 63 and are not exposed to an exterior of the sewing machine 1.

The movable member 53 includes a guide 54 having a guide surface 54*a* disposed adjacent to (e.g., in contact with or with a space from) the cutter blade 51. In the space between the guide 54 and the cutter blade 51, no member may be disposed. The guide surface 54*a* is a surface that contacts a thread to be cut during the course of cutting the thread with the cutter blade 51. The guide 54 is configured to receive force from the thread at the guide surface 54*a* during the course of cutting the thread with the cutter blade 51 and move in a moving direction E (as in FIG. 7) which is a longitudinal direction of the blade edge 52 (e.g., the blade length direction Y). The moving direction E of the guide 54 may include a component of the blade length direction Y, and may be a downward-and-rightward direction or a lower-right direction in the illustrative embodiment. The guide 54 may be located, relative to the cutter blade 51, to a side closer to the rear end 69 of the needle plate 6. In other words, the guide 54 may be located closer to the rear end 69 of the needle plate 6 than the cutter blade 51. The rear end 69 corresponds to a downstream end of the needle plate 6 in the feed direction of the feed unit 60.

Figures 5A, 5B:
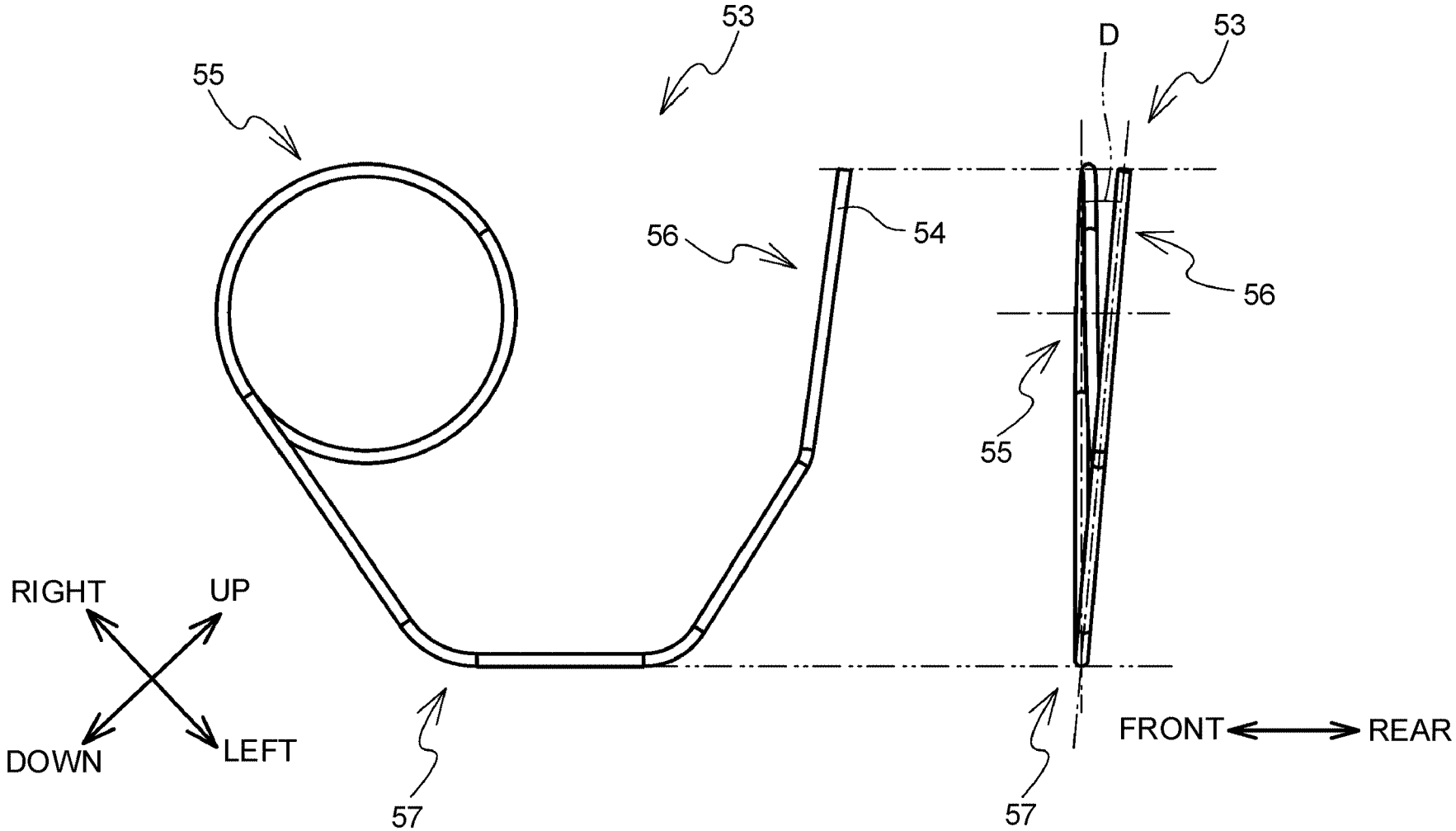
FIG. 5A is a rear view of a movable member of the thread cutter.
FIG. 5B is a perspective view of the movable member.

The movable member 53 in the illustrative embodiment includes a metal wire having elasticity. An example of metal includes stainless steel. The movable member 53 has an annular first end portion 55 inserted over the fixing portion 70. The first end portion 55 of the movable member 53 is disposed between a holding portion 71 (described below) of the fixing portion 70 and the holding plate 63, and is fixed by the screw 67. The movable member 53 has a second end portion 56 opposite to the first end portion 55. The second end portion 56 has a second end, which is a free end, and the guide 54 having the guide surface 54*a*. As depicted in FIG. 5B, the second end portion 56 of the movable member 53 is bent or deformed, relative to the first end portion 55 of the movable member 53, such that an angle D defined between the first end portion 55 and the second end portion 56 is approximately 1 to 10 degree(s). The movable member 53 has a middle portion 57 bent into a "U" shape. The middle portion 57 is held between the cutter blade 51 and the holding plate 63, and is pressed toward the cutter blade 51 such that the middle portion 57 is in a substantially same plane as the first end portion 55. The movable member 53 is fixed to the fixing portion 70 such that the second end portion 56 of the movable member 53 is urged or pressed toward the cutter blade 51 in the thickness direction of the cutter blade 51. The second end portion 56 having the guide 54 may thus be brought into contact with the cutter blade 51. As long as the guide surface 54*a* of the guide 54 is disposed adjacent to the cutter blade 51 as described above, the guide 54 and the cutter blade 51 may be separated from each other. In this configuration, a distance between the guide 54 and the cutter blade 51 may preferably be shorter than a dimension of an exposed portion 80 of the blade edge 52 in the blade length direction Y, more preferably, equal to or shorter than one-half of the dimension of the exposed portion 80 in the blade length direction Y. The exposed portion 80 is a portion of the blade edge 52 of the cutter blade 51 that is not held between the holder 61 and the holding plate 63.

Figure 2:
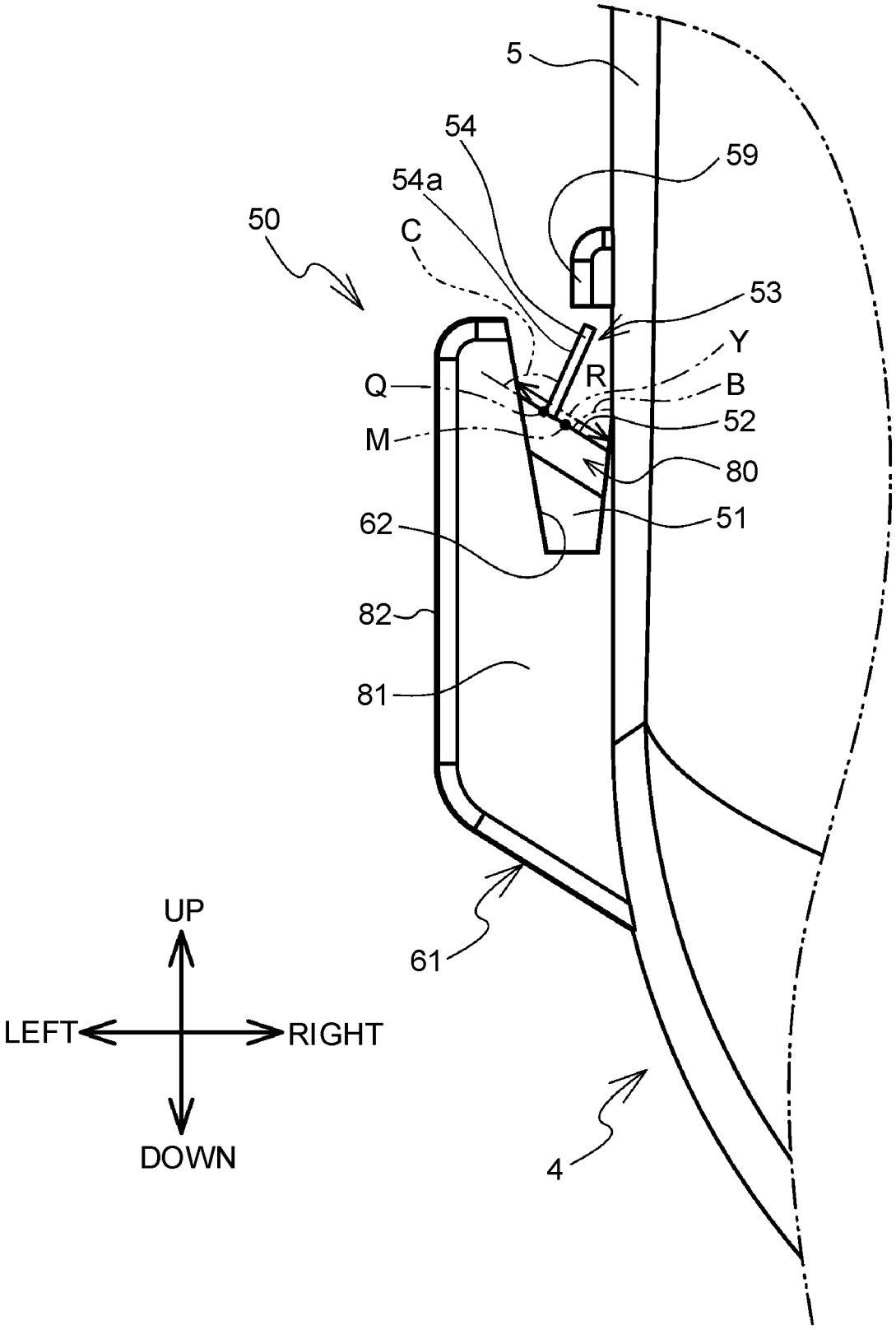
FIG. 2 is a front view of a thread cutter of the sewing machine.
Figure 3:
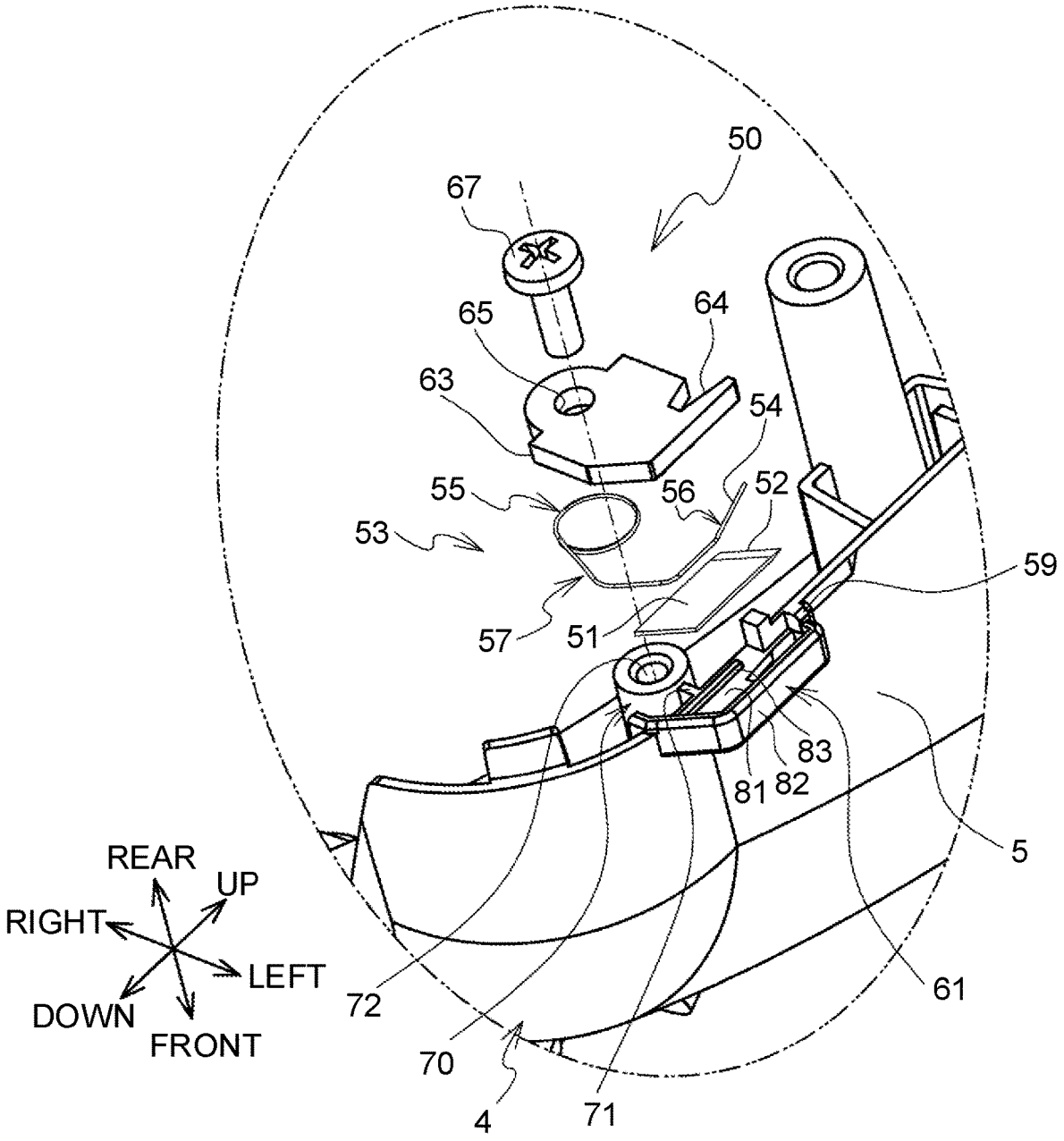
FIG. 3 is an exploded perspective view of the thread cutter.
Figure 4:
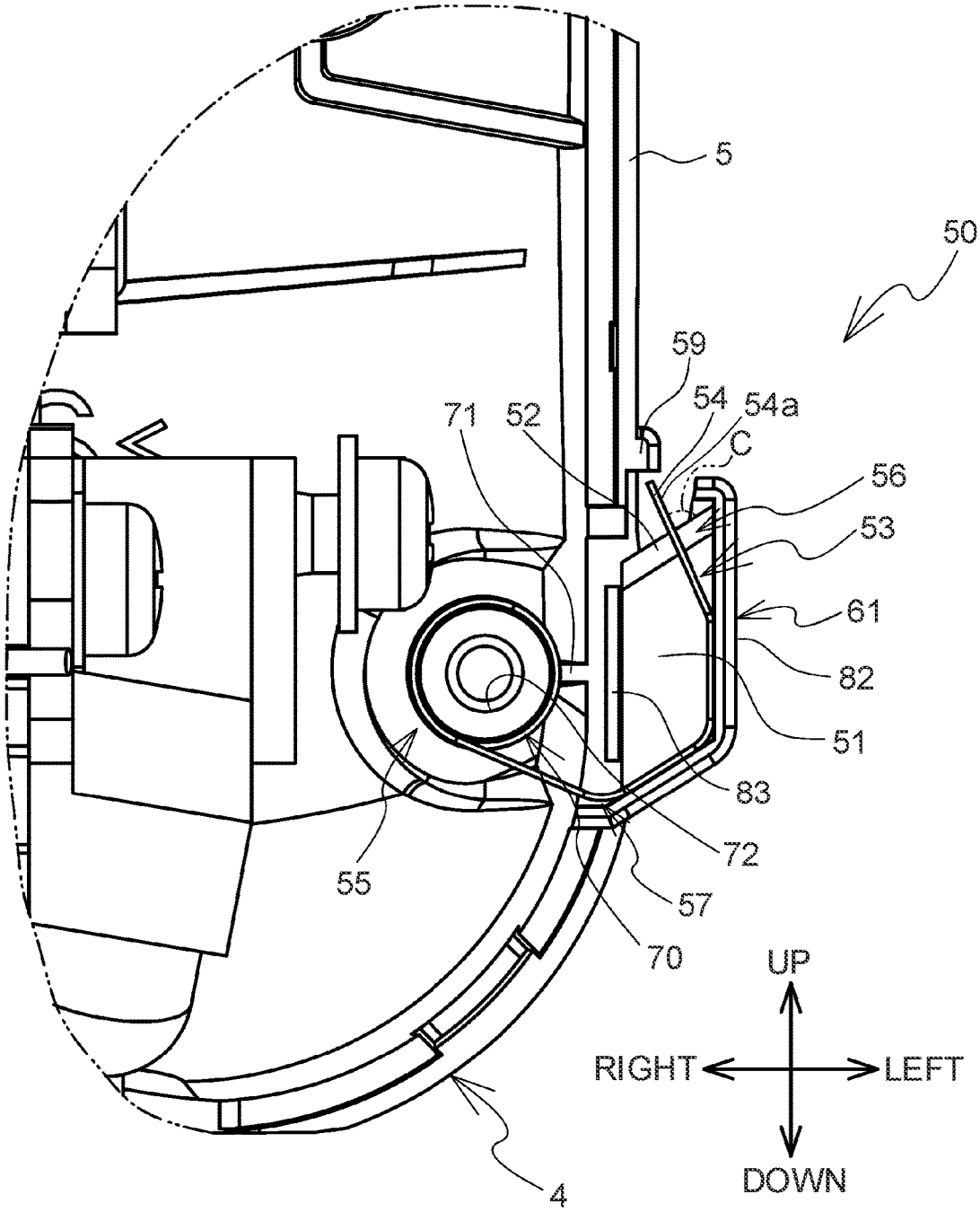
FIG. 4 is a rear view of the thread cutter from which a holding plate is removed.

As depicted in FIG. 2, the exposed portion 80 has a center M in the blade length direction Y. A portion of the guide 54 (e.g., the guide surface 54*a*) of the movable member 53 closest to the blade edge 52 is located upstream of the center M in the moving direction E (e.g., located to the upper left of the center M). The guide 54 of the movable member 53 is configured to elastically move in the blade length direction Y toward the horizontal arm 4, based on the reception of the force from a thread at the guide surface 54*a* (e.g., in response to the application of the force from the thread to the guide surface 54*a*).

The guide 54 extends leftward from the top to the bottom in a front view. In the front view, the guide surface 54*a* crosses the blade edge 52 at a point Q. In other words, when the guide 54 and the cutter blade 51 are projected onto a plane perpendicular to the thickness direction of the cutter blade 51, the projected guide surface 54*a* crosses the projected blade edge 52 of the cutter blade 51 at the point Q. In short, the guide 54 includes a portion extending in the up-down direction from the blade edge 52 toward a direction away from the blade edge 52 (e.g., from a portion corresponding to the point Q to the second end of the movable member 53). A portion of the guide 54 having the guide surface 54*a* that is closest to the blade edge 52 corresponds to the point Q. The point Q is located upstream of the center M in the moving direction E (e.g., located to the upper left of the center M). The guide surface 54*a* and the blade edge 52 define an angle C that is an acute angle.

Figure 6:
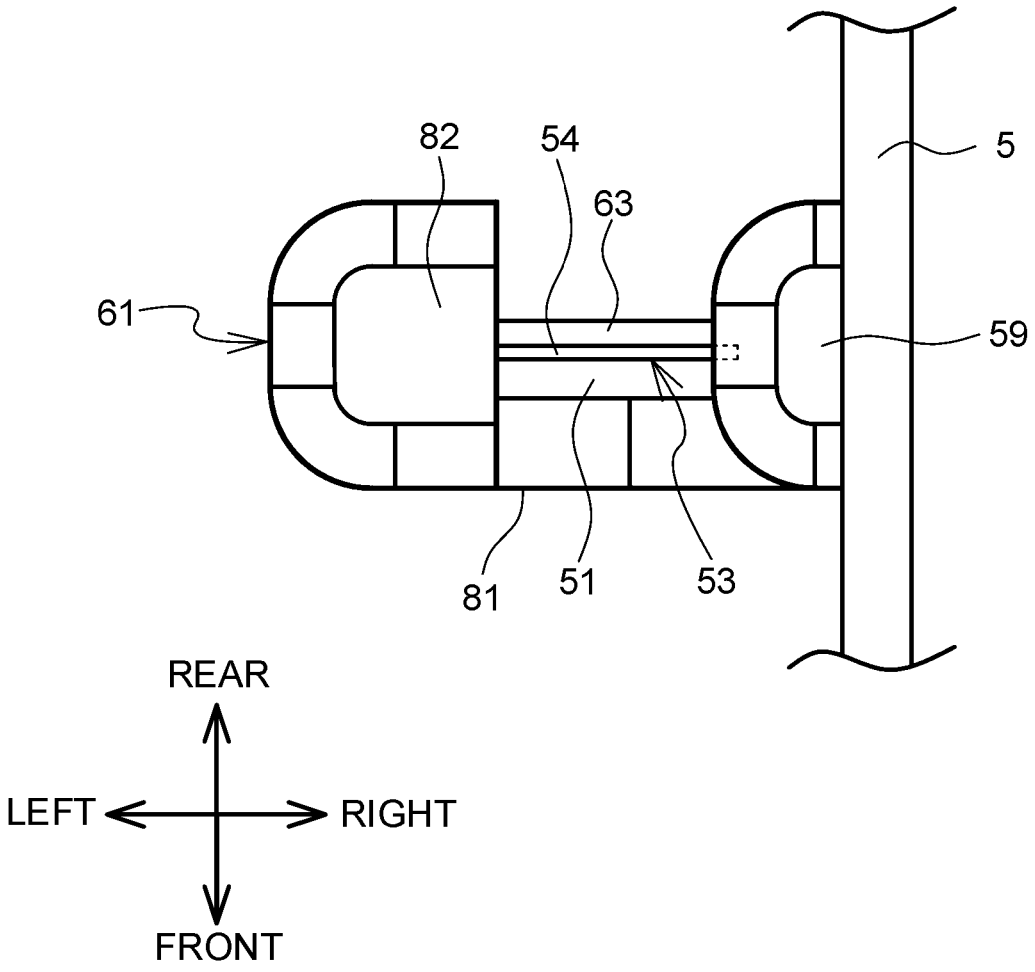
FIG. 6 is a top view of the thread cutter.

The protrusion 59 protrudes from the face plate 5 in a direction in which the horizontal arm 4 is elongated (e.g., toward the left). The protrusion 59 is located downstream of the point Q in the moving direction E. As depicted in FIG. 6, the second end of the movable member 53, which is a part of the guide 54, overlaps with the protrusion 59 in a direction (e.g., the up-down direction) parallel to the face plate 5 and perpendicular to the thickness direction (e.g., the front-rear direction) of the cutter blade 51. A portion of the guide 54 overlapping with the protrusion 59 in the up-down direction is located between the blade edge 52 and the protrusion 59 in the up-down direction. The protrusion 59 may help the thread to contact the guide surface 54*a* and may prevent the thread from being located between the guide 54 and the face plate 5. The lower end of the protrusion 59 is located above the upper end of the cutter blade 51 and slightly above the upper end of the holder 61.

The holder 61 together with the holding plate 63 hold the cutter blade 51 and the movable member 53. The holder 61 may be integral with the face plate 5. The holder 61 includes a front wall 81, a peripheral portion 82, and a right wall 83. The front wall 81 extends perpendicularly leftward from the face plate 5. The front wall 81 has a recess 62 at an upper end portion thereof. The front wall 81 faces the front surface of the cutter blade 51. The peripheral portion 82 extends rearward from a periphery of the front wall 81. The peripheral portion 82 faces the upper left end, the left end, and the lower end of the cutter blade 51. The peripheral portion 82 has a dimension in the front-rear direction that is greater than the thickness of the cutter blade 51. The right wall 83 extends in the up-down direction and faces the right end of the cutter blade 51. The right wall 83 has a dimension (e.g., a thickness) in the front-rear direction that is approximately equal to the thickness of the cutter blade 51. The holding plate 63 is disposed in parallel with an extending surface of the cutter blade 51. The holding plate 63 faces the rear surface of the cutter blade 51. The holding plate 63 has a recess 64 and a hole 65. Each of the recesses 62 and 64 has the same shape and defines the exposed portion 80 of the blade edge 52. The hole 65 is located at a right portion of the holding plate 63 and extends through the holding plate 63 in the front-rear direction. The screw 67 is inserted into the hole 65. The fixing portion 70 has a tubular shape extending in the front-rear direction. The fixing portion 70 includes the holding portion 71 and a screw hole 72. The holding portion 71 extends leftward from a left portion of a peripheral surface of the fixing portion 70. The holding portion 71 has a rear end that positions, in the front-rear direction, the first end portion 55 of the movable member 53 inserted over the fixing portion 70. With the cutter blade 51 positioned in the holder 61 and the first end portion 55 of the movable member 53 inserted over the fixing portion 70, the screw 67 may be inserted into the screw hole 72 of the fixing portion 70 through the hole 65. This may position the cutter blade 51, which is held between the holder 61 and the holding plate 63, in the up-down direction, the front-rear direction, and the left-right direction.

Figures 7A, 7B:
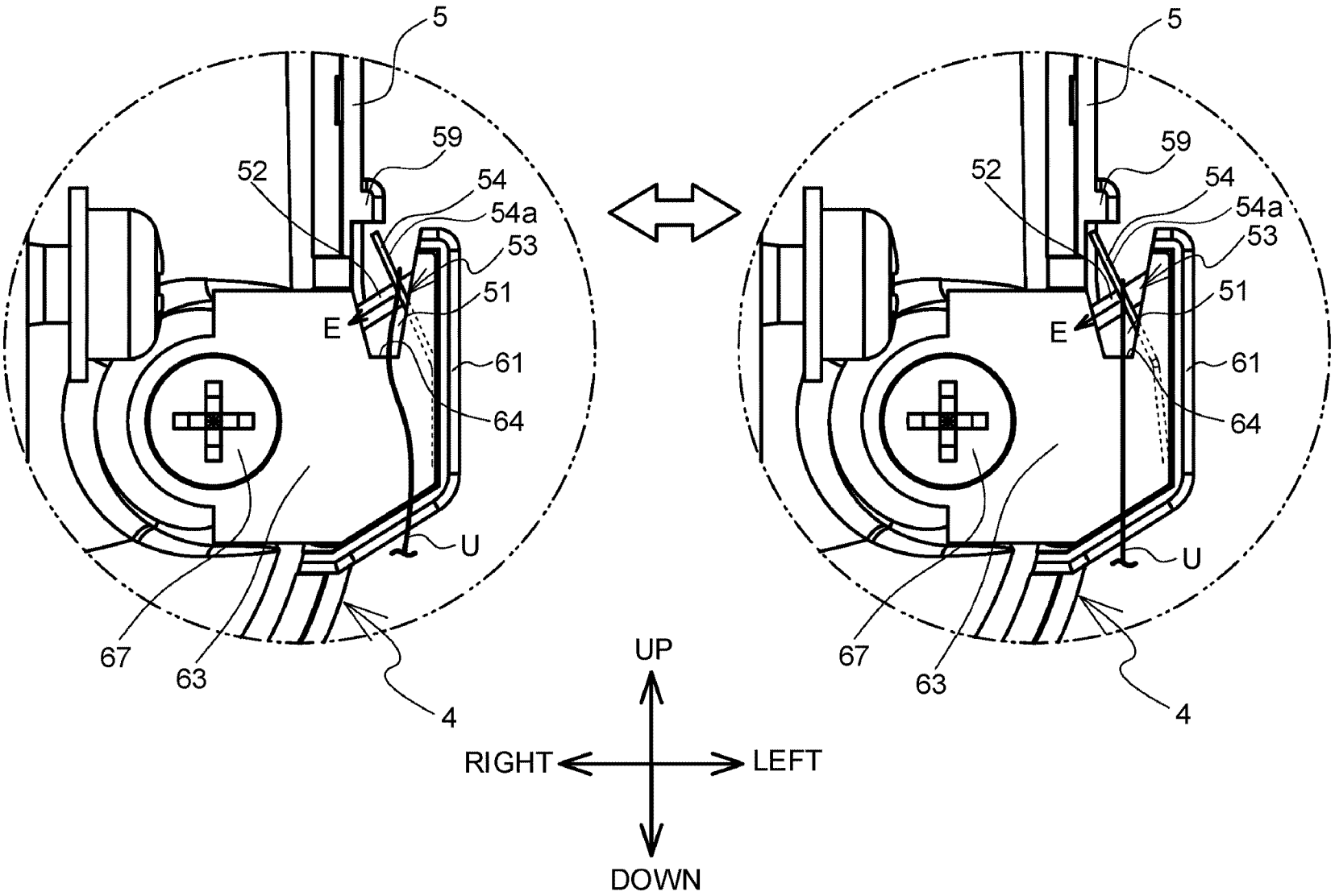
FIG. 7A is a diagram of a process for cutting a thread with the thread cutter, illustrating a rear view of the movable member that has not moved.
FIG. 7B is a diagram of a process for cutting a thread with the thread cutter, illustrating a rear view of the movable member that has moved.

Referring to FIGS. 7A and 7B, an operation of cutting a thread U using the thread cutter 50 according to the first illustrative embodiment will now be described. As depicted in FIG. 7A, a user of the sewing machine 1 may pass the thread U through the thread cutter 50 from the rear toward the front of the thread cutter 50. The thread U may be guided by the protrusion 59, and contact the guide surface 54*a* of the movable member 53 from the left, and the blade edge 52 of the cutter blade 51. In this case, the movement of the thread U in the blade length direction Y may be restricted by the movable member 53, so that the thread U may contact the blade edge 52 at a position upstream of a downstream end, in the moving direction E, of the exposed portion 80 of the blade edge 52. The user brings a portion of the thread U to be cut into contact with the blade edge 52 and pulls the thread U in the moving direction E of the guide 54 (e.g., in a lower-right direction). As depicted in FIG. 7B, the guide 54 may elastically move in the blade length direction Y toward the horizontal arm 4 based on the reception of the force from the thread U at the guide surface 54*a*. The thread U may be pressed onto the blade edge 52 of the cutter blade 51 while pushing the guide surface 54*a* in the moving direction E, and be cut by the blade edge 52. After the thread U has been cut, the guide 54 of the movable member 53 may move, due to its elasticity, toward a direction opposite to the moving direction E. As depicted in FIG. 7A, the guide 54 may move back to its initial position, due to the elasticity.

Figure 8:
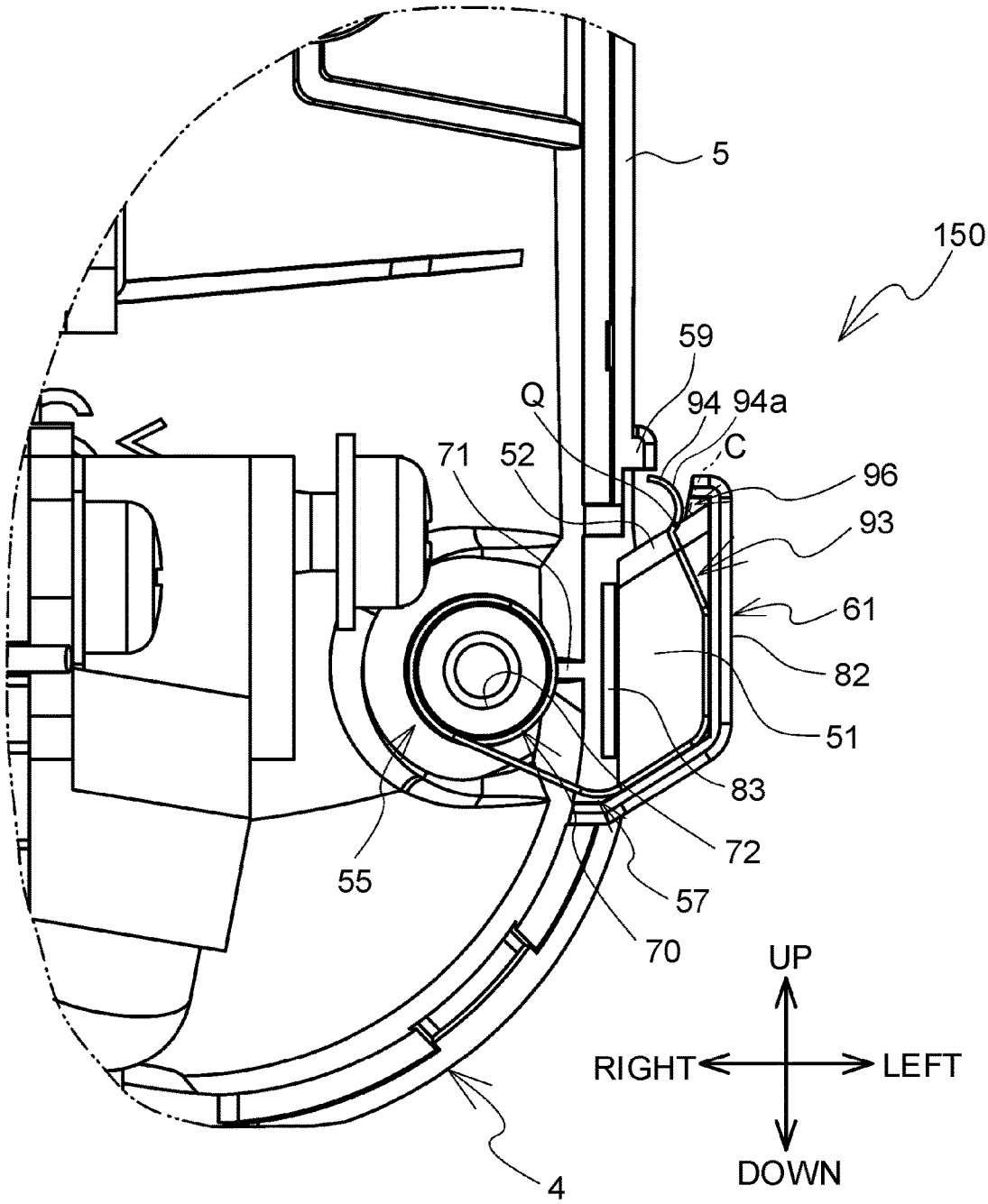
FIG. 8 is a rear view of a thread cutter in a second illustrative embodiment according to one or more aspects of the disclosure.

Referring to FIG. 8, a thread cutter 150 according to the second illustrative embodiment will now be described. It is to be noted that the reference numerals in FIG. 8 designate similar components of the thread cutter 50 according to the first illustrative embodiment, and a detailed explanation thereof with respect to the second illustrative embodiment, is omitted herein. The thread cutter 150 according to the second illustrative embodiment has a similar configuration to the thread cutter 50 according to the first illustrative embodiment, except for a movable member. The thread cutter 150 includes a movable member 93, which is different from the movable member 53 of the first illustrative embodiment, with respect to a guide 94 provided at a second end portion 96. The guide 94 has an arch shape when projected onto a plane perpendicular to the thickness direction (e.g., the front-rear direction) of the cutter blade 51. The guide 94 has a guide surface 94*a* that contacts a thread to be cut during the course of cutting the thread with the cutter blade 51. The movable member 93 has a fixed first end portion 55 and an opposite second end portion 96, which is a free end. In one example, the guide 94 when projected onto a plane, may have an arch shape curving convexly in a direction opposite to the moving direction E. The guide surface 94*a* and the blade edge 52 define an angle C which is an acute angle. An operation of cutting a thread using the thread cutter 150 according to the second illustrative embodiment may be performed similarly to the operation as is performed using the thread cutter 50 of the first illustrative embodiment.

Figure 9:
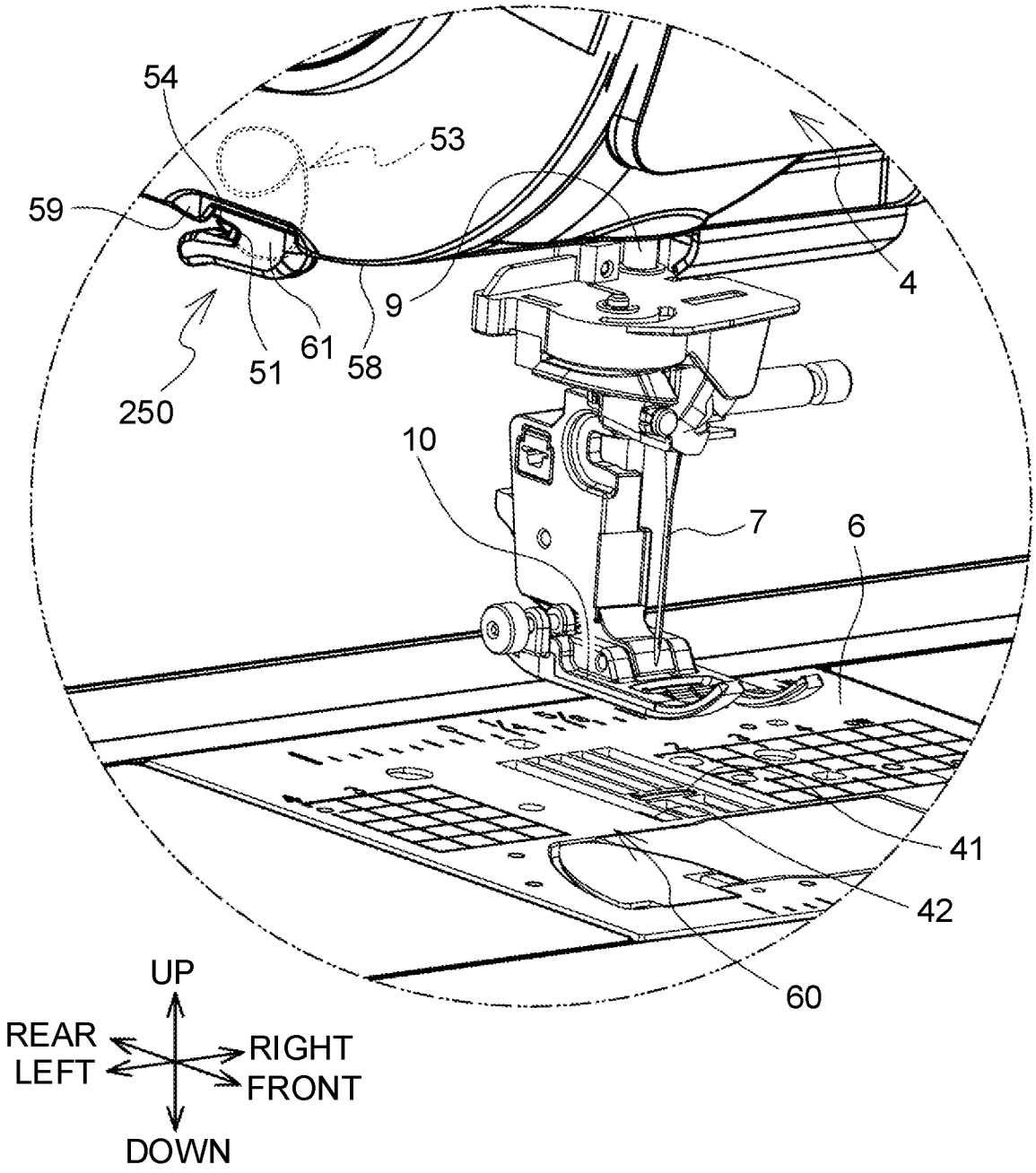
FIG. 9 is a perspective view of a thread cutter in a third illustrative embodiment according to one or more aspects of the disclosure.

Referring to FIG. 9, a thread cutter 250 according to the third illustrative embodiment will be described. The thread cutter 250 has a similar configuration to the thread cutter 50 according to the first illustrative embodiment, except for a fixing surface to which the thread cutter 250 is fixed and an orientation of the thread cutter 250. The thread cutter 250 includes a blade edge 52 that extends upward from the rear to the front. In the third illustrative embodiment, the longitudinal direction of the blade edge 52 (e.g., a blade length direction Y) corresponds to a direction from lower rear to upper front. The thread cutter 250 is fixed to a fixing surface, e.g., a lower surface 58 of the horizontal arm 4. The blade length direction crosses the extending surface of the needle plate 6. The cutter blade 51 has a thickness in the left-right direction. In other words, a thickness direction of the cutter blade 51 in the third illustrative embodiment extends in the left-right direction. The guide 54 is located closer to the needle hole 41 in the left-right direction, than the cutter blade 51 is to the needle hole 41. In the third illustrative embodiment, the guide 54 is located to the right of the cutter blade 51. The guide 54 of the movable member 53 is configured to move in an upper-front direction.

An operation of cutting a thread using the thread cutter 250 will now be described. A user may pass the thread through the thread cutter 250 from the right toward the left. The thread may be guided by the protrusion 59, and contact the guide surface 54*a* of the movable member 53 from the rear and the blade edge 52 of the cutter blade 51. In this case, the movement of the thread in the blade length direction Y may be restricted by the movable member 53, so that the thread may contact the blade edge 52 at a position further to the rear than the front end portion of the exposed portion of the blade edge 52. The user brings a portion of the thread to be cut into contact with the blade edge 52 and pulls the thread in the moving direction of the guide 54 (e.g., in an upper-front direction). The guide 54 may elastically move in the blade length direction Y toward the horizontal arm 4 based on the reception of the force from the thread at the guide surface 54*a*. The thread may be pressed onto the blade edge 52 while pushing the guide surface 54*a* in an upper-front direction, and be cut by the blade edge 52. After the thread has been cut, the guide 54 of the movable member 53 may move, due to its elasticity, toward a direction opposite to the moving direction of the movable member 53 (e.g., in a lower-rear direction). The guide 54 may move back to its initial position, due to the elasticity.

The sewing machine 1 according to the first to third illustrative embodiments may allow the guide 54, 94 of the movable member 53, 93 to move in the blade length direction Y, based on the reception of the force from a thread during the course of the thread cutting with the cutter blade 51. The thread may slidably move in the blade length direction Y while pushing the guide surface 54*a*, 94*a*, and be cut with a sharp portion (e.g., unworn portion) of the blade edge 52. The sewing machine 1 may prevent or reduce wear of a particular portion of the blade edge 52 of the cutter blade 51. This may eliminate or reduce influences of the wear of the cutter blade 51 of the thread cutter 50 when cutting a thread with the cutter blade 51.

The sewing machine 1 according to the first and second illustrative embodiments includes the needle plate 6 and the feed unit 60 configured to feed a workpiece placed on the needle plate 6 in the feed direction. The guide 54, 94 is located, relative to the cutter blade 51, closer to the rear end 69 of the needle plate 6. In other words, the guide 54, 94 is located closer to the rear end 69 of the needle plate 6 than the cutter blade 51. When a user passes a thread to be cut from the rear side toward the front side (e.g., from a side closer to the rear end 69 toward a side further away from the rear end 69), the sewing machine 1 according to the first and second illustrative embodiments may allow the thread to be pressed onto the cutter blade 51 more readily as compared with a configuration in which the guide 54, 94 is located further away from the rear end 69 of the needle plate 6 than the cutter blade 51. For example, in a case where the user cuts both an upper thread and a lower thread using the thread cutter 50, 150 after the end of sewing, the user may pull the upper thread and the lower thread toward a downstream side in the feed direction of the feed unit 60. In such case, it may be easier for the user to pass the threads over the cutter blade 51 from a side closer to the rear end 69 (e.g., a downstream end in the feed direction) of the needle plate 6, toward a side away from the rear end 69, as compared with a case in which the user passes the threads over the cutter blade 51 from the side further away from the rear end 69 toward the side closer to the rear end 69.

The sewing machine 1 according to the third illustrative embodiment includes the needle plate 6 having the needle hole 41. The guide 54 is located closer to the needle hole 41 than the cutter blade 51. When a user passes a thread to be cut over the cutter blade 51 from a side closer to the needle hole 41 toward a side further away from the needle hole 41, the configuration of the third illustrative embodiment may allow the thread to be pressed onto the cutter blade 51 more readily, as compared with a configuration in which the guide 54 is located further away from the needle hole 41 than the cutter blade 51. For example, a user of the sewing machine 1 may cut an upper thread and a lower thread using the thread cutter 250 after the end of sewing. It may be easier for the user to pass the threads over the cutter blade 51 from a side closer to the needle hole 41 toward a side further away from the needle hole 41, as compared with a case in which the user passes the threads over the cutter blade 51 from the side further away from the needle hole 41 toward the side closer to the needle hole 41.

In the sewing machine 1 according to the first to the third illustrative embodiments, when the guide 54, 94 and the cutter blade 51 are projected onto a plane perpendicular to the thickness direction of the cutter blade 51, the guide 54, 94 crosses the blade edge 52 of the cutter blade 51. The guide surface 54*a*, 94*a* of the movable member 53, 93 and the blade edge 52 define an acute angle. This configuration may allow the guide surface 54*a*, 94*a* to receive force from the thread more readily and move in the moving direction E more readily, as compared with a configuration in which an angle defined by the guide surface 54*a*, 94 a and the blade edge 52 is an obtuse angle.

The sewing machine 1 according to the first to third illustrative embodiments, a portion of the guide 54, 94 of the movable member 53, 93 that is closest to the blade edge 52 (e.g., the portion corresponding to the point Q) is located upstream, in the moving direction E, of the center M of the exposed portion 80 (indicted by an arrow R in FIG. 2) in the blade length direction Y. This configuration may allow the blade edge 52 of the cutter blade 51 to be used widely to cut a thread, as compared with a configuration in which a portion of the guide 54, 94 of the movable member 53, 93 that is closest to the blade edge 52 is located downstream, in the moving direction E, of the center M of the exposed portion 80 in the blade length direction Y.

The sewing machine 1 according to the first to the third illustrative embodiments includes the horizontal arm 4 including the face plate 5 that covers an end portion of the sewing machine 1. The thread cutter 50, 150, 250 is fixed on a fixing surface of the horizontal arm 4. The guide 54, 94 of the movable member 53, 93 is configured to elastically move in the blade length direction Y toward the horizontal arm 4 based on the reception of force from a thread. The sewing machine 1 includes the movable member 53, 93 with a relatively simple configuration. After the thread has been cut, the guide 54, 94 may move, due to its elasticity, in a direction away from the horizontal arm 4.

In the sewing machine 1 according to the first to the third illustrative embodiments, an angle defined by the blade edge 52 and the fixing surface of the horizontal arm 4 is an acute angle. This configuration may reduce a space between the cutter blade 51 and the fixing surface of the horizontal arm 4, as compared with a configuration in which an angle defined by the blade edge 52 and the fixing surface of the horizontal arm 4 is an obtuse angle. Reduction of the space between the cutter blade 51 and the fixing surface of the horizontal arm 4 may prevent or reduce entrance of an object other than a thread into the space. Further, the sewing machine 1 may allow the guide 54, 94 to move toward the horizontal arm 4 more readily, as compared with a configuration in which an angle defined by the blade edge 52 and the fixing surface of the horizontal arm 4 is an obtuse angle.

The sewing machine 1, according to the first to the third illustrative embodiments, includes the horizontal arm 4 including the fixing surface and the protrusion 59 that protrudes from the fixing surface toward a direction in which the horizontal arm 4 is elongated. A portion of the guide 54, 94 overlaps with the protrusion 59 in a direction parallel to the fixing surface and perpendicular to the thickness direction of the cutter blade 51. The protrusion 59 may prevent a thread from being located closer to the horizontal arm 4 than the guide 54, 94.

In the sewing machine 1 according to the second illustrative embodiment, the guide 94, when projected onto a plane perpendicular to the thickness direction of the cutter blade 51, has an arch shape. This configuration may allow a user to put a thread between the guide 94 (e.g., the guide surface 94*a*) and the blade edge 52 more readily, as compared with a guide extending linearly when projected onto a plane.

In the sewing machine 1 according to the second illustrative embodiment, the guide 94, when projected onto a plane perpendicular to the thickness direction of the cutter blade 51, has an arch shape curving convexly in a direction opposite to the moving direction E. The guide 94 of the sewing machine 1 may receive force from a thread more readily and move in the blade length direction Y more readily, as compared with a guide with an arch shape curving convexly in the moving direction E when projected onto the plane perpendicular to the thickness direction of the cutter blade 51.

The sewing machine 1 according to the first to third illustrative embodiments includes the movable member 53, 93 including the guide 54, 94 including an elastic wire. The guide 54, 94 is configured to be elastically deformed in the moving direction E by the application of force from a thread to the guide surface 54*a*, 94*a*. The sewing machine 1 includes the movable member 53, 93 that is formed by processing (e.g., curving/bending) a single member, and has a simpler configuration than a movable member including a plurality of members.

The sewing machine 1 according to the first to third illustrative embodiments, includes the movable member 53, 93 having the first end portion 55 and the second end portion 56, 96. The first end portion 55 is fixed to the sewing machine 1 while the second end portion 56, 96 is not fixed and is free. The sewing machine 1 may facilitate a configuration to fix the movable member 53, 93.

The sewing machine 1 according to the first to third illustrative embodiments, includes the movable member 53, 93 that is fixed such that the second end portion 56, 96 may be urged toward the cutter blade 51 in the thickness direction of the cutter blade 51. This configuration may prevent or reduce a gap between the cutter blade 51 and the movable member 53, 93. Accordingly, the sewing machine 1 may cut a thread more stably, as compared with a configuration in which a gap is provided between the cutter blade 51 and the movable member 53, 93.

While aspects are described in detail with reference to the specific embodiments thereof, this is merely an example, and various changes, arrangements and modifications may be made therein without departing from the spirit and scope of the disclosure. For example, the following modifications may be made.

Configuration of the sewing machine 1 may be modified as desired. The sewing machine 1 may be an industrial sewing machine, an embroidery sewing machine, or a multiple needle sewing machine. The feed direction of the feed unit 60 may be changed as desired. A direction in which the horizontal arm is elongated may be the same as or cross the feed direction in which a workpiece is fed by the feed unit.

A position where the thread cutter is located, and an orientation of the thread cutter relative to the sewing machine may be changed as desired. For example, a thread cutter may be fixed to at least one of the bed and the horizontal arm of the sewing machine in an orientation in which the extending surface of the cutter blade is parallel with the extending surface of the needle plate. The cutter blade may be configured to cut a lower thread on the needle plate. In this configuration, a movable member may be disposed, for example, below a cutter blade (e.g., opposite to the horizontal arm 4 relative to the cutter blade). The longitudinal direction of the blade edge (e.g., the blade length direction) may cross the needle plate or be parallel to the extending surface of the needle plate. An angle defined by the blade edge and the fixing surface may be a right angle or an obtuse angle. An angle defined by the guide surface of the movable member and the blade edge may be a right angle or an obtuse angle.

The movable member may include any guide that has a guide surface disposed adjacent to a cutter blade. The guide may be configured to receive force from a thread at the guide surface during the course of cutting the thread with the cutter blade and move in a moving direction which is a longitudinal direction of the blade edge (e.g., the blade length direction). For a movable member, a plurality of members or components may be combined. In this configuration, the movable member may include, for example, an urging member, and a member that is connected to the urging member and has a guide surface. Examples of the urging member include a compression spring, a tension spring, a link, and a magnet. The spring may not be limited to, for example, a coil spring, but may be a plate spring. Material of the urging member may be metal, plastic, or rubber. The movable member may not necessarily have elasticity. In this configuration, the movable member may, for example, include a guide that has a guide surface disposed adjacent to the cutter blade and that is configured to move along a rail extending in the blade length direction. The moving direction of the guide may include a component of the blade length direction, and may or may not be parallel to the blade length direction.

The shape of the guide of the movable member may be changed as desired. For example, the guide may be curved or flat. A guide, when projected onto a plane perpendicular to the thickness direction of the cutter blade, has an arch shape curving convexly in the moving direction. A length of a portion of a movable member having a guide may be changed as desired. The second end portion of the guide 54 may protrude, relative to a portion of the face plate 5 above the blade edge 52, toward the blade edge 52 in a direction away from the face plate 5. In this configuration, a position where the blade edge cuts a thread may also be restricted by bringing the thread into contact with the guide surface. The guide may be located closer to an upstream end of the needle plate in the feed direction of the feed unit, than the cutter blade. In other words, a portion of the movable member 53 (e.g., the guide 54) may be located in front of the cutter blade 51 unlike the above-described illustrative embodiment in which a portion of the movable member 53 (e.g., the guide 54) is located behind the cutter blade 51.

In some embodiments, the guide may be located further away from the needle hole, than the cutter blade.

A portion of the guide of the movable member closest to the blade edge may be located at the same position as a center, in the blade length direction, of an exposed portion of the blade edge or downstream, in the moving direction, of the center of the exposed portion of the blade edge. An end portion of the cutter blade opposite to the blade edge may be fixed to the sewing machine such that the blade edge may be fully exposed to an exterior of the sewing machine.

The sewing machine may not necessarily include the protrusion. In this configuration, a movable member may be configured of an urging member including rubber cord. The movable member may be located crossing the cutter blade when projected onto a plane perpendicular to the thickness direction of the cutter blade, and a second end portion of the movable member may be fixed to the fixing surface of the horizontal arm. In another embodiment, a movable member may be configured of a wire, similar to the first illustrative embodiment. When the guide and the cutter blade are projected onto a plane perpendicular to the thickness direction of the cutter blade, the guide may be located crossing the cutter blade and a second end portion of the guide may overlap with the cutter blade. This configuration may also prevent a thread to be cut from being located closer to the fixing surface than the guide. The shape and location of the protrusion may be changed as desired. For a wire movable member, both the first end portion and the second end portion may be fixed to the sewing machine. In this configuration, a guide may be located at a middle portion of the movable member. For a wire movable member, both the first end portion and the second end portion may not be fixed but free. In this configuration, a middle portion of the movable member may be fixed to the sewing machine. The second end portion of the movable member may not necessarily be urged toward the cutter blade in the thickness direction of the cutter blade. A portion of the guide of the movable member may be disposed at a position not overlapping with the protrusion in a direction parallel to the fixing surface and perpendicular to the thickness direction of the cutter blade. In this configuration, for example, a portion of the guide may be disposed at a position overlapping with the protrusion in the thickness direction of the cutter blade.

The sewing machine 1 may include one or more cutter blades 51 and one or more movable members 53. For example, one movable member 53 may be located between two cutter blades 51, or one cutter blade 51 may be located between two movable members 53.

What is claimed is:

1. A sewing machine, comprising:
a thread cutter including:
a cutter blade having a blade edge configured to cut a thread; and
a movable member including a guide having a guide surface adjacent to the cutter blade, the guide being configured to receive force from the thread at the guide surface during the course of cutting the thread with the cutter blade by slidably moving the thread in a longitudinal direction of the blade edge and to move in a moving direction which is the longitudinal direction of the blade edge,
wherein the movable member includes a wire having elasticity and the guide is configured to move in the moving direction by being elastically deformed by the force received from the thread.

2. The sewing machine according to claim 1, further comprising:
a needle plate; and
a feed unit configured to feed a workpiece placed on the needle plate in a feed direction,
wherein the guide surface is located closer to a downstream end of the needle plate in the feed direction than the cutter blade.

3. The sewing machine according to claim 1, further comprising a needle plate having a needle hole,
wherein the guide surface is located closer to the needle hole than the cutter blade.

4. The sewing machine according to claim 1, wherein when the guide surface and the blade edge of the cutter blade are projected onto a plane perpendicular to a thickness direction of the cutter blade, the guide surface crosses the blade edge, such that the guide surface and the blade edge define an acute angle.

5. The sewing machine according to claim 4, wherein a portion of the guide surface closest to the blade edge is located upstream, in the moving direction, of a center of an exposed portion of the cutter blade in the longitudinal direction of the blade edge, the center of the exposed portion being exposed to an exterior of the sewing machine.

6. The sewing machine according to claim 1, further comprising a horizontal arm including a face plate that covers an end portion of the sewing machine,
wherein the thread cutter is fixed at a fixing surface of the horizontal arm, and
wherein the guide is configured to elastically move in the longitudinal direction of the blade edge toward the horizontal arm based on the reception of the force from the thread.

7. The sewing machine according to claim 6, wherein an angle defined by the blade edge and the face plate is an acute angle.

8. The sewing machine according to claim 6, further comprising:
a protrusion protruding from the fixing surface in a direction in which the horizontal arm is elongated, and
a portion of the guide overlaps with the protrusion in a direction parallel to the face plate and perpendicular to a thickness direction of the cutter blade.

9. The sewing machine according to claim 4, wherein when the guide surface is projected onto the plane perpendicular to the thickness direction of the cutter blade, the guide surface has an arch shape.

10. The sewing machine according to claim 9, wherein the arch shape is convexly curved in a direction opposite to the moving direction.

11. The sewing machine according to claim 10, wherein the movable member has a first end portion that is fixed at a head of a horizontal arm of the sewing machine and a second end portion that is a free end.

12. The sewing machine according to claim 11, wherein the first end portion of the movable member is fixed such that the second end portion is urged toward the cutter blade in the thickness direction of the cutter blade.

13. A sewing machine, comprising:
a horizontal arm; and
a thread cutter fixed at a fixing surface of the horizontal arm, the thread cutter including:
a cutter blade having a blade edge configured to cut a thread; and a movable member including a guide having a guide surface adjacent to the cutter blade, the guide being configured to move in a moving direction which is a longitudinal direction of the blade edge, wherein the guide is configured to elastically move in the longitudinal direction of the blade edge toward the horizontal arm, and wherein an angle defined by the blade edge and the fixing surface is an acute angle.

* * * * *